US011377916B2

(12) United States Patent
Rodgers et al.

(10) Patent No.: US 11,377,916 B2
(45) Date of Patent: Jul. 5, 2022

(54) POLISH ROD LEVELING ASSEMBLY

(71) Applicant: REDHEAD SERVICES, L.L.C., Odessa, TX (US)

(72) Inventors: Brandon Lee Rodgers, Big Spring, TX (US); Jarod Lane Shelton, Midland, TX (US)

(73) Assignee: Redhead Services, L.L.C., Odessa, TX (US)

( * ) Notice: Subject to any disclaimer, the term of this patent is extended or adjusted under 35 U.S.C. 154(b) by 177 days.

(21) Appl. No.: 16/876,840

(22) Filed: May 18, 2020

(65) Prior Publication Data

US 2021/0355769 A1 Nov. 18, 2021

(51) Int. Cl.

| | |
|---|---|
| ***E21B 33/03*** | (2006.01) |
| ***E21B 19/24*** | (2006.01) |
| ***E21B 47/009*** | (2012.01) |
| ***E21B 43/12*** | (2006.01) |

(52) U.S. Cl.
CPC ..... *E21B 19/24* (2013.01); *E21B 43/127* (2013.01); *E21B 47/009* (2020.05)

(58) Field of Classification Search
CPC ..... E21B 33/08; E21B 43/127; E21B 33/03; F16J 15/187; F16J 15/182; F16C 33/102
See application file for complete search history.

(56) References Cited

U.S. PATENT DOCUMENTS 1,771,250 A * 7/1930 Feild ..... E21B 33/08 277/330
1,904,631 A * 4/1933 Roye ..... E21B 33/08 277/511
2,480,055 A * 8/1949 Seaton ..... F16J 15/183 277/516
3,243,212 A * 3/1966 Diethelm ..... F16C 41/005 285/190
3,404,877 A * 10/1968 Darnell ..... F04B 53/145 267/128
3,683,474 A * 8/1972 Young, Jr. ..... F16C 33/103 29/898.051
3,732,923 A * 5/1973 Fowler ..... E21B 43/013 166/347
4,019,425 A * 4/1977 Matzelle ..... F04B 1/2042 91/487
4,213,512 A * 7/1980 Mazziotti ..... F16C 35/042 74/665 F (Continued)

OTHER PUBLICATIONS

Image of an installed prior art leveling plate (undated but admitted to be prior art).

*Primary Examiner* — Kipp C Wallace
(74) *Attorney, Agent, or Firm* — McAfee & Taft

(57) ABSTRACT

A leveling assembly that is capable of lubrication without separating the individual leveling plates. The leveling assembly comprising: a first plate having a convex curved surface having a curvature, the first plate defining a central bore therethrough; a second plate having a concave curved surface shaped to mate with the convex curved surface; the second plate defining a central bore therethrough. One of the first or second plates defines a lubrication passageway extending from a first opening on an exterior surface thereof to a second opening on the curved surface, and a lubrication groove extending from the second opening to the central bore of the plate with the lubrication passageway.

17 Claims, 5 Drawing Sheets

(56) References Cited

U.S. PATENT DOCUMENTS

| | | | | |
|---|---|---|---|---|
| 4,480,842 | A * | 11/1984 | Mahyera | F16J 15/187 277/516 |
| 4,579,350 | A * | 4/1986 | Knox | F16J 15/56 277/928 |
| 5,590,966 | A * | 1/1997 | Cherny | F16L 27/08 384/38 |
| 6,293,347 | B1 | 9/2001 | Cahill | |
| 9,702,203 | B2 * | 7/2017 | Bolstad, Jr. | E21B 19/00 |
| 10,107,371 | B2 | 10/2018 | Rappenecker et al. | |
| 10,295,417 | B2 * | 5/2019 | Hart | G01L 1/2206 |
| 2013/0174665 | A1 * | 7/2013 | Silva | G01N 3/04 73/788 |

* cited by examiner

POLISH ROD LEVELING ASSEMBLY

BACKGROUND

At various production wells, oil and gas is extracted using one of several types of reciprocating pumps. In a common application, the pump includes a series of sucker rods extending below the surface of the earth within a stationary series or string of production tubing, commonly referred to as a drill string. The production tubing is often positioned within a wellbore casing. A pump is coupled to the end of the sucker rod string acting on the downhole pump, which draws fluid (e.g., oil or gas) into the production tubing and raises the fluid to the surface of the earth. The sucker rod string is connected to a polish rod, which in turn is coupled to a pivoting beam or walking beam on a pump jack using a polish rod clamp, an optional rod rotator, an option load sensor, optional leveling plates, and an optional spacer. The polish rod extends upward from the sucker rod string to a carrier bar, which is connected by cables to one end of the walking beam.

In operation, the reciprocating rods (polish rod and sucker rods) tend to rub against the inside of the production tubing. This occurs particularly in the cases of slanted wells where the rods tend to rest on the lower side of tubing. To limit or distribute the inevitable wear, a rod-rotator is used to incrementally rotate the polish rod each pump stroke. To better monitor the stress and strain placed on the string of sucker rods, a load cell gauge (load cell) which measures the load may be used and integrated with a pump controller. To help ensure accurate measurements by the load cell, leveling plates (a leveling assembly) are (is) used to correct for misalignments between the carrier bar and the polish rod.

The polish rod is suspended by a polish rod clamp. The polish rod clamp can rest on one or any combination of the carrier bar, spacer, leveling assembly, load cell, or rod-rotator. The carrier bar is suspended from the horsehead of the pump jack by a cable bridle. The polish rod extends through the carrier bar. Misalignment of the polish rod relative to the carrier bar can result in contact of the carrier bar and polish rod, which can cause damage to the polish rod and inaccurate measurements by the load cell. In many applications a load cell is in turn supported by leveling plates. The leveling assembly is supported by the carrier bar, or a spacer (which is supported by the carrier bar). Subsequent rotation of the polish rod results in circumferential scoring at the interface of the carrier bar and the polish rod thereby weakening the polish rod.

Examples of misalignment between the carrier bar and the polish rod include:

a) mechanical misalignment of the carrier bar;

b) a slow or restricting down stroke and a resultant slackening of the cable bridle causing angular movement of the carrier bar; and c) a misaligned polish rod extending from the wellhead seal.

If a polish rod fails the sucker rod string could fall into the downhole bore, potentially releasing well fluid (oil or gases) from the stuffing box seal and initiating an expensive recovery operation.

Preventive maintenance calls for replacement of scored polish rods and regularly lubricating leveling plates. Lubricating the existing leveling plate designs requires: relieving the polish rod and sucker rod string weight from the carrier bar, loosening the polish rod clamp, separating the plates, and then applying grease into the space between the leveling plates. This means finding an alternate means to support the sucker rod string weight. Because of this need for alternate weight support, a mistake or disruption during the current greasing process increases the risk that the sucker rod string could fall into the downhole bore. Proper maintenance helps to ensure the polish rod remains in good condition by helping to minimize or prevent circumferential scoring.

In a common configuration a load cell sits atop a leveling plate assembly (leveling assembly), which in turn sits atop a carrier bar. A polish rod extends therethrough and is centered relative to the load cell and the leveling assembly. Despite being centered, the polish rod is still subject to misalignment and wear. The leveling assembly is intended to help correct misalignment between the carrier bar and the polish rod; however, existing leveling plate assemblies may corrode diminishing their ability to adjust for variations in alignment over time. The corrosion may in some cases be due to a lack of maintenance. It is difficult to properly grease the current leveling assembly and lubricating between the leveling plates is more likely to be neglected. In addition to wear on the polish rod from the resulting misalignment, the load cell may not accurately read the forces exerted on it if the polish rod and carrier bar are misaligned.

SUMMARY OF THE DISCLOSURE

One aspect of this disclosure relates to a leveling assembly comprising two plates, a first plate and a second plate. The first plate has a convex curved surface on one side and is substantially flat on the other side. The first plate also defines a central bore therethrough. The central bore has a diameter larger than a polish rod that will pass therethrough. The second plate has a concave curved surface on one side and is substantially flat on the other side. The concave curved surface is shaped to mate with the convex curved surface on the first plate. The second plate also defines a central bore therethrough. The central bore of the second plate has a diameter that is similar in size to that of the first diameter. One of the plates, either the first plate or the second plate, defines a lubrication passageway extending from a first opening on an exterior surface thereof to a second opening on the curved surface. The lubrication passageway is connected to a lubrication groove that extends from the second opening on the curved surface. In one embodiment the lubrication groove extends to the central bore of whichever plate defines the lubrication passageway.

BRIEF DESCRIPTION OF THE DRAWINGS

The drawings included with this application illustrate certain aspects of the embodiments described. However, the drawings should not be viewed as illustrating exclusive embodiments. The subject matter disclosed is capable of considerable modifications, alterations, combinations, and equivalents in form and function, as will occur to those skilled in the art with the benefit of this disclosure.

DETAILED DESCRIPTION

The present disclosure may be understood more readily by reference to this detailed description. Numerous specific details are set forth in order to provide a thorough understanding of the various embodiments described herein. However, it will be understood by those of ordinary skill in the art that the embodiments described herein can be practiced without these specific details. In other instances, methods and components have not been described in detail so as not to obscure the related relevant feature being described. Also, the description is not to be considered as limiting the scope of the embodiments described herein.

As used herein and in the appended claims, a component or method that "comprises" or "includes" one or more specified parts means that the component or method includes the specified parts alone, or includes the specified parts together with one or more additional parts.

As used herein and in the appended claims, a component or method "comprising" or "including" one or more specified steps or parts means that the component or method includes the specified steps or parts alone, or includes the specified steps or parts together with one or more additional steps or parts.

Figure 1:
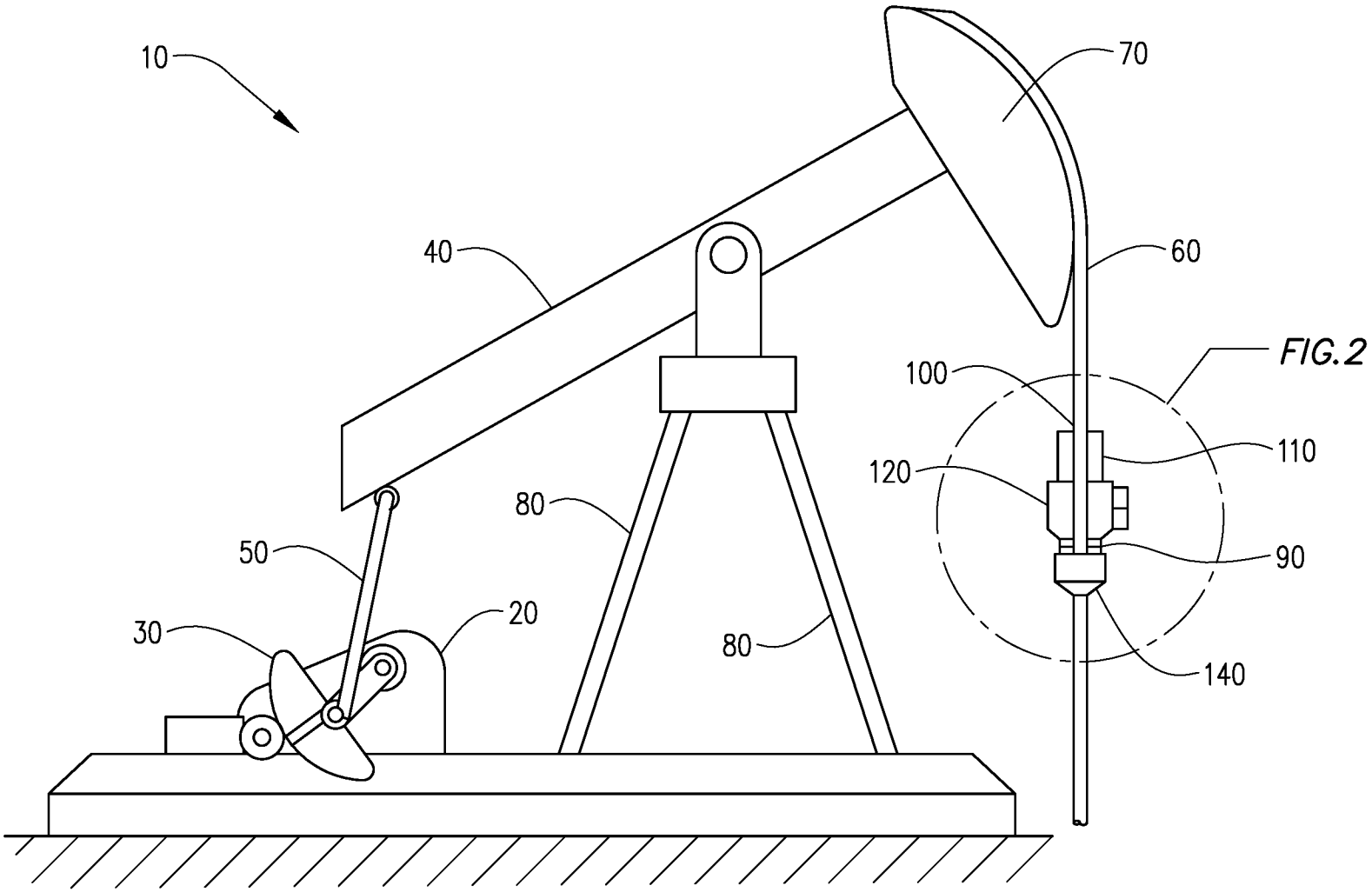
FIG. 1 is a perspective view of a conventional pump jack for reciprocating the sucker rod string of a downhole pump.
Figure 2:
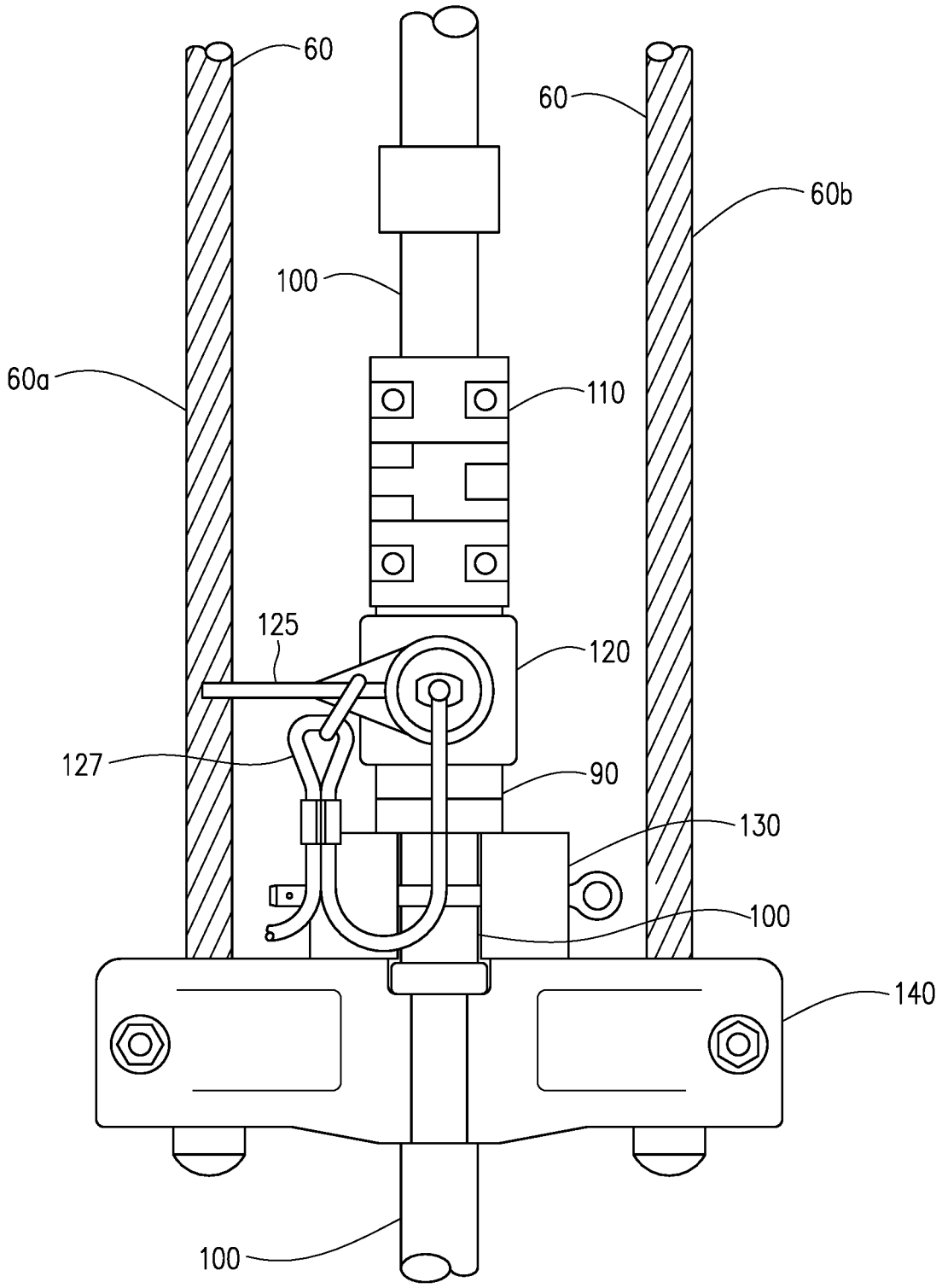
FIG. 2 is a detail view of a cable bridle with one embodiment of a leveling assembly supporting a load cell, mounted to the polish rod, and supported by a spacer and carrier bar.

Referring now to FIG. 1, a pump jack 10 is shown driving a reciprocating pump (not shown) located downhole in the bore of a subterranean oil well. The pump jack assembly 10 includes a gearbox 20 powered by a motor (not shown). The gearbox 20 is used to turn a crank and counter weight 30. The crank and counter weight 30 is connected to walking beam 40 by a pitman arm 50. Walking beam 40 is supported by Sampson posts 80. A horsehead 70, located at one end of a walking beam 40, delivers the reciprocal pumping stroke to the pump (not shown). A cable bridle assembly shown in FIG. 2 is suspended from cables 60*a*, 60*b* which roll tangentially over the horsehead 70 as it reciprocates. A carrier bar 140 is hung from the end of the cable bridle 60. A string of sucker rods (not shown) and polish rod 100 are suspended from the carrier bar 140. The sucker rods (not shown) extend down the production tubing (not shown) to drive the subterranean pump (not shown).

Referring to FIG. 2, a detailed view of a cable bridle 60 incorporating one embodiment of the leveling assembly 90 mounted to a polish rod 100 is shown. A polish rod 100 is connected to the top of the sucker rods (not shown). The polish rod 100 extends upwardly through a stuffing box seal (not shown) and through a bore in the carrier bar 140. A polish rod clamp 110 is secured to the polish rod 100 above the carrier bar 140. The weight of the polish rod 100 is borne by the polish rod clamp 110, which bears against the carrier bar 140 through a load cell 120, a leveling assembly 90, and spacer 130.

Cable bridle 60 and carrier bar 140 connect the polish rod 100 using the polish rod clamp 110 to the horsehead 70, which is connected to the walking beam 40. Load cell 120 is held in place on polish rod 100 by the polish rod clamp 110 on top, and is supported by leveling assembly 90 on the bottom. The polish rod 100 passes through the load cell 120. Handle 125 attaches to one of the cables 60*a* to prevent rotation of load cell 120 relative to the polish rod 100. Wiring 127 carries signals from load cell 120 to the well controller (not shown) or other data collection or controlling device (not shown).

The load cell 120 shown in FIGS. 1 and 2, converts the load acting on it into electrical signals. The load cell may for example comprise strain gauges attached, bonded, or otherwise connected onto a beam or structural member that deforms when weight is applied.

Most applications for load sensors or weight sensors using strain gauges have a straight forward mechanism for applying the load to the weight sensor. Typical weight sensors have a plate or pad on which the item being weighed can be placed; however, some applications, such as measuring the load on a polish rod 100 are more problematic due to the shifting load. As described in FIG. 1, the pump jack 10 uses the polish rod 100 to operate a pump in the well. As a result the polish rod 100 is continually placed under tension and compression loads as it moves through the pumping cycle. Control applications for the well require a measurement of the load being placed on the polish rod 100 during the pumping cycle. This load is measured during the pumping stroke by the load cell 120.

The leveling plates in current leveling assemblies, which are frequently used to support load cells, may corrode, or oxidize, between the individual leveling plates. The corrosion, or oxidation, creates friction and binding between the mating surfaces of the leveling plates and restricts the ability of the leveling assembly to compensate for alignment variations. The alignment variations if uncorrected can cause the load cell 120 to incorrectly report loads sensed, and can also cause the polish rod to score and fail. The current leveling assembly maintenance requires significant effort and creates unnecessary risk of a costly reclamation effort, which could cause operators to neglect lubricating between the leveling plates.

Figure 3:
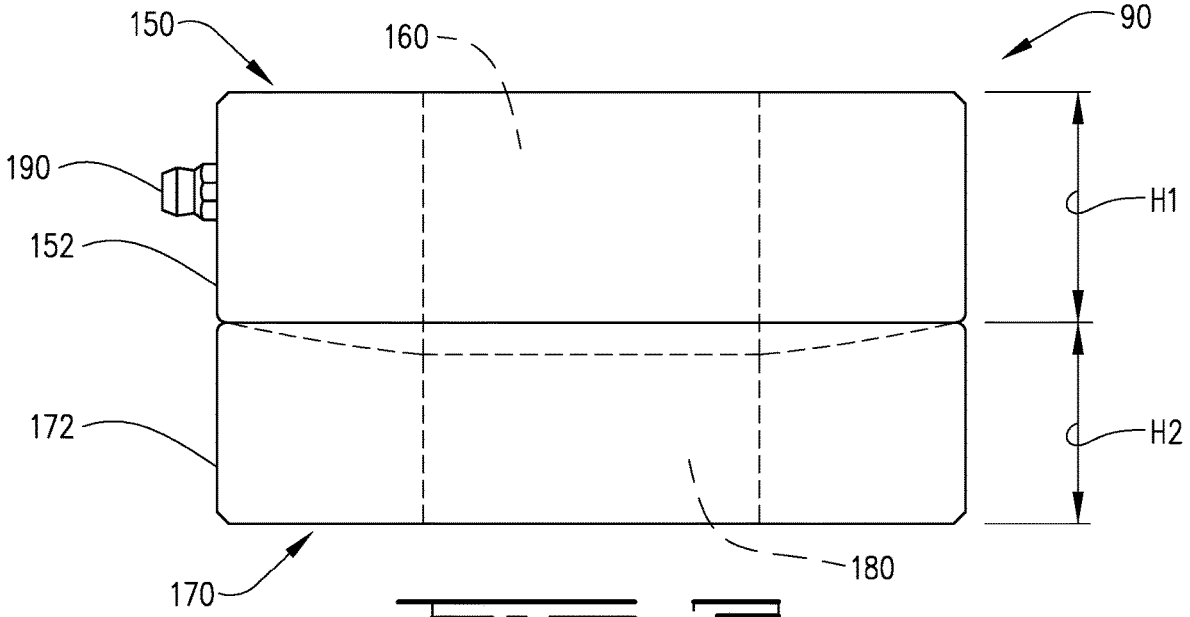
FIG. 3 is a side view of one embodiment of the leveling assembly as mated in use, showing the leveling plates aligned and stacked together.
Figure 4:
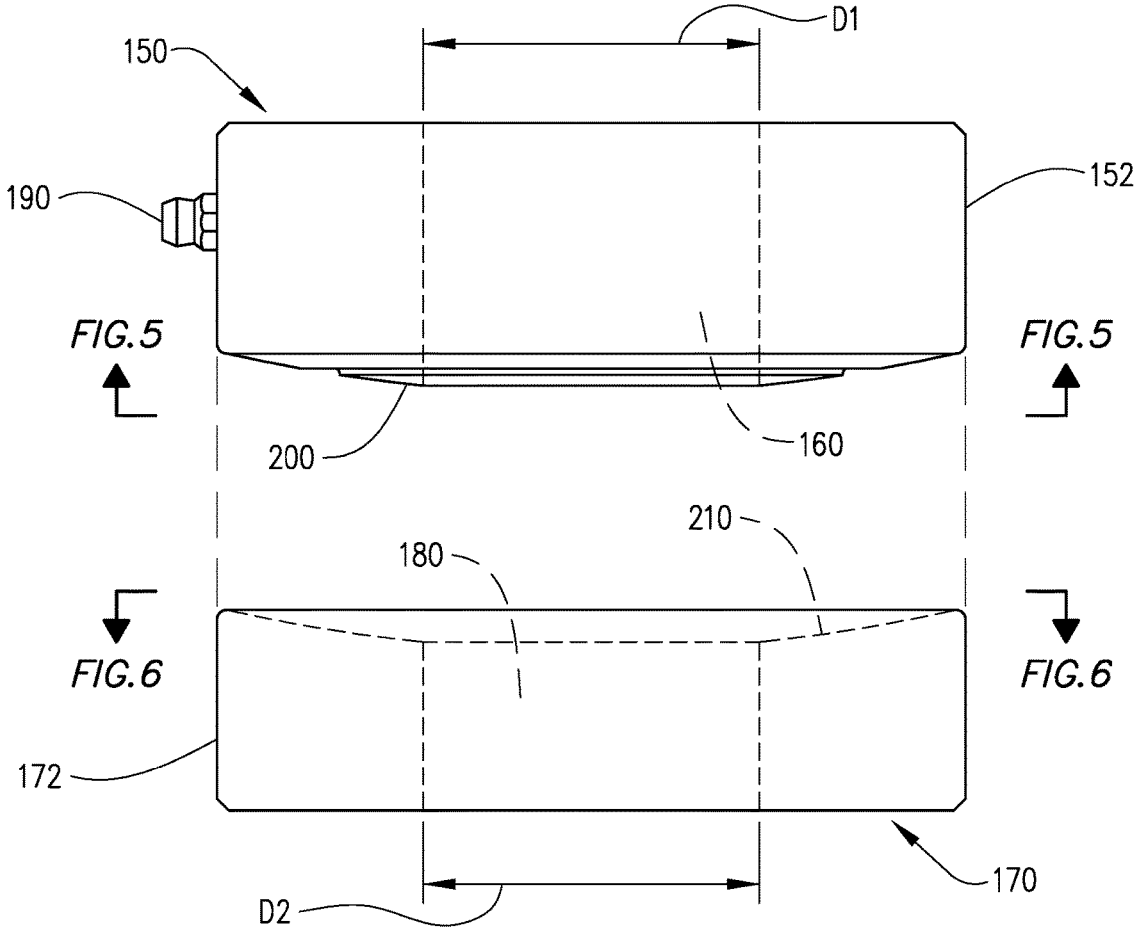
FIG. 4 is a side view of one embodiment of the leveling assembly separated showing each leveling plate aligned with the other and separated.

Referring now to FIGS. 3 and 4, one embodiment of the leveling assembly 90 according to the concepts described herein is shown. FIG. 3 is a side view of the leveling assembly 90 with first and second plates 150 and 170 aligned and stacked together (mated). FIG. 4 is a side view of the leveling assembly 90 with plates 150 and 170 aligned but separated (un-mated). The embodiment of FIGS. 3 and 4 includes first plate 150 having a convex curved surface 200, the first plate 150 defining a central bore 160 therethrough with a first diameter D1. The first plate also has a first height, or outer diameter thickness, H1. In other words plate 150 has a thickness H1 at an outer periphery thereof. Also included is a second plate 170 having a concave curved surface 210 shaped to mate with the convex curved surface 200. The second plate also defines a central bore 180 therethrough with a second diameter D2. The second plate has a second height, or outer diameter thickness, H2. In other words plate 170 has a thickness H2 at an outer periphery thereof. D1 and D2 as shown here are substantially similar in size, but each can be varied if desired. One example of when D1 and D2 might be different is when using a protective sleeve for the polish rod 100. In this case, the plate on top will have a larger diameter bore than that of the bottom plate. This would allow the lip of the sleeve to fit within the upper bore, while the lower bore would act as a base for the sleeve to rest on. Likewise, H1 and H2 as shown here are substantially similar in size, but each can be varied if desired.

Figure 7:
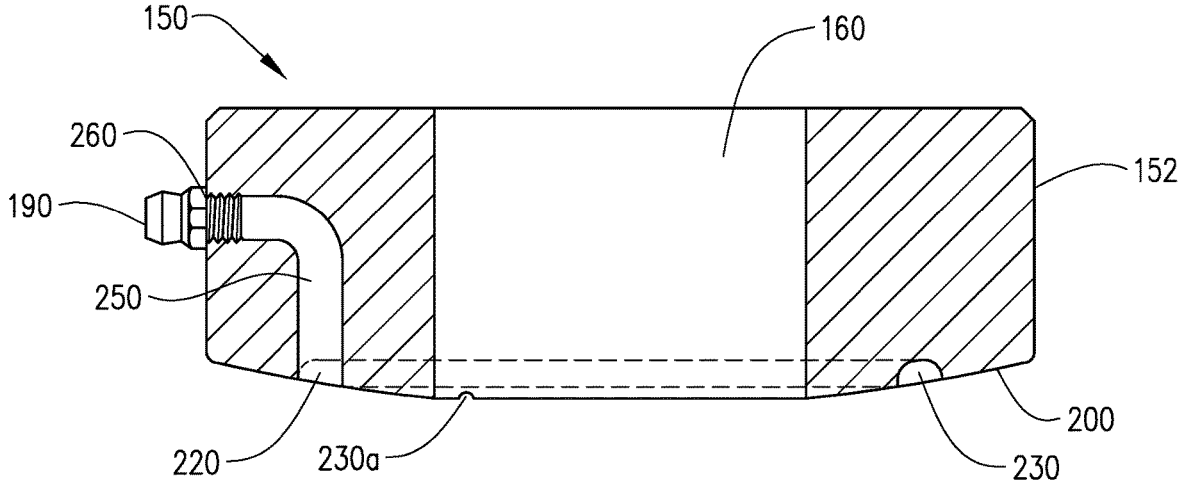
FIG. 7 is a cross-section view of one embodiment of a plate having a convex curved surface.
Figure 8:
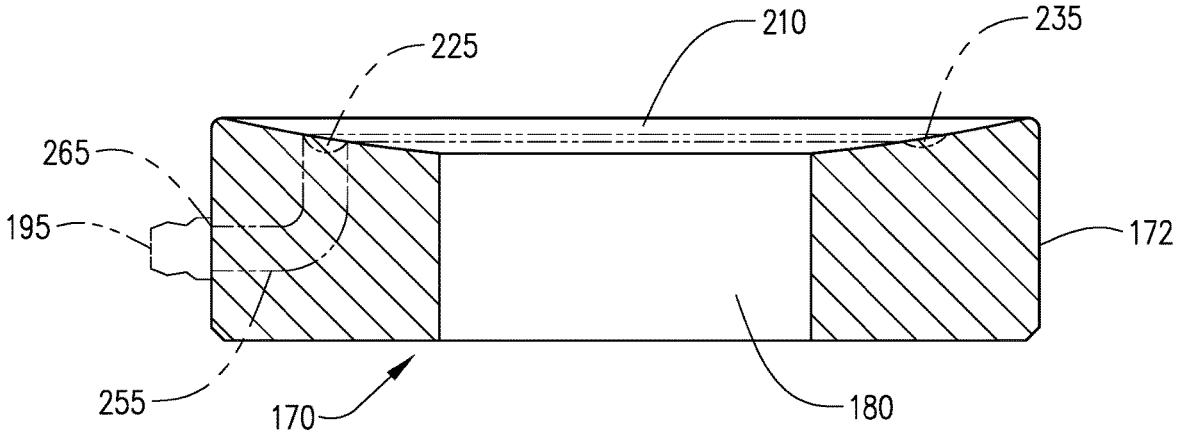
FIG. 8 is a cross-section view of one embodiment of a plate having a concave curved surface.

Although not shown in FIGS. 3 and 4, the polish rod 100 passes through the central bore 160 of first plate 150 and through the central bore 180 of second plate 170. This configuration is depicted in FIGS. 1 and 2. Also not shown in FIGS. 3 and 4 are the lubrication passageways; however, lubrication passageway 250 in the first plate 150, and lubrication passageway 255 in the second plate 170 are illustrated in FIGS. 7 and 8. The illustrations above were not shown for clarity.

There is no default orientation for the first plate 150 and second plate 170 other than the convex curved surface 200 should face (mate with) the concave curved surface 210. Meaning, either the first plate 150 or the second plate 170 can be on top relative to the carrier bar 140 or spacer 130, but the plates should be mated together so that the convex curved surface 200 of the first plate 150 fits against the concave curved surface 210 of the second plate 170. Some applications may dictate an orientation, such as mentioned above with the sleeve, but absent such a need the leveling assembly 90 will work in either orientation. In the embodiment shown plate 150 is the upper plate.

Figure 5:
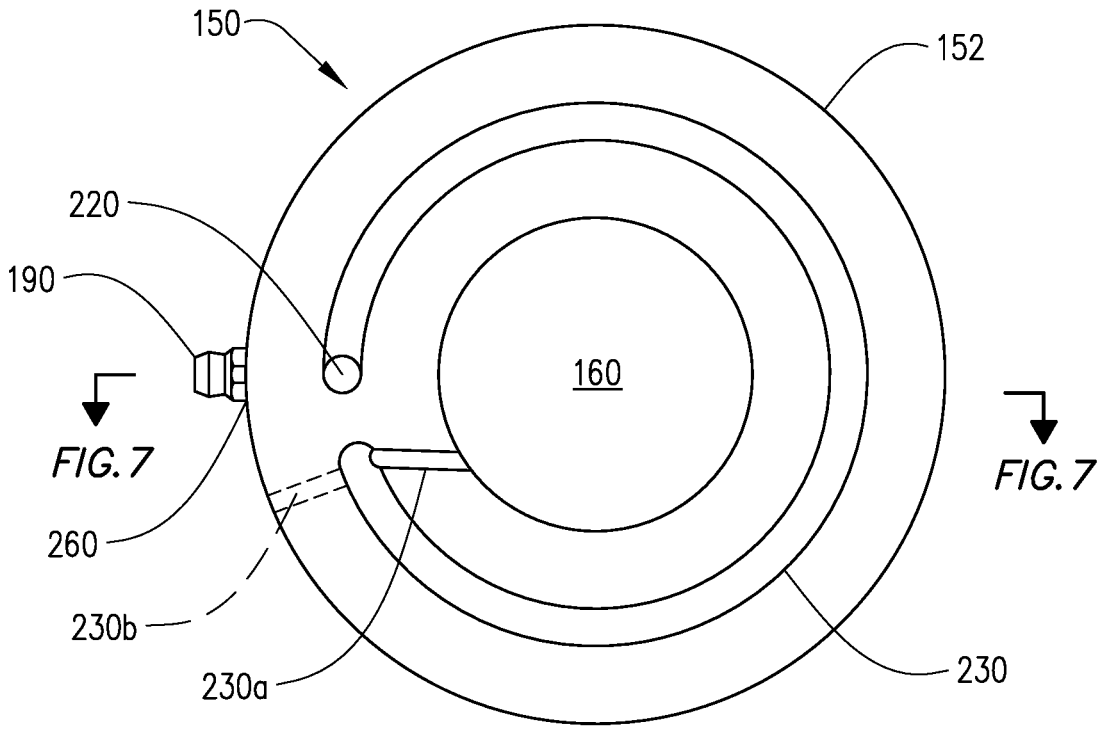
FIG. 5 is a top view of one embodiment of a plate having a convex curved surface.
Figure 6:
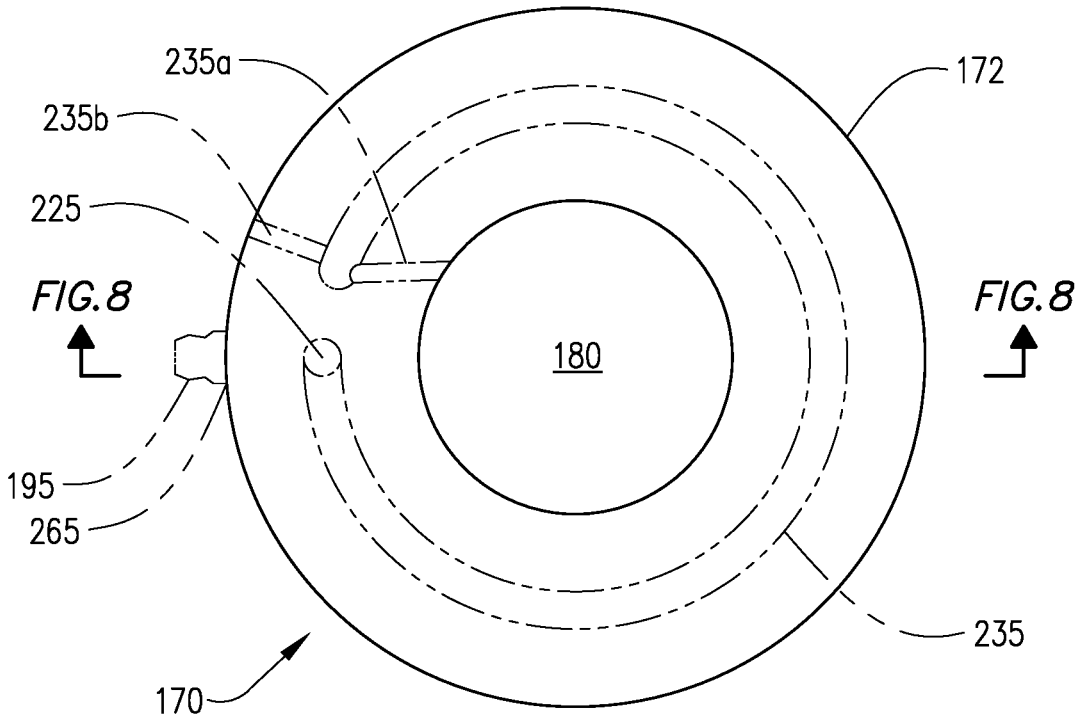
FIG. 6 is a top view of one embodiment of a plate having a concave curved surface.

Referring now to FIGS. 5 and 6, one embodiment of the leveling assembly 90 according to the concepts described herein is shown. FIG. 5 shows a view of the curved surface 200 of the first plate. A lubrication fitting 190, which may be for example a zerk fitting is installed into a first opening 260 defined in the outer surface 152 at the periphery thereof. A lubrication passageway 250 (shown in FIG. 7) extends from first opening 260 to a second opening 220 located on convex surface 200. A lubrication groove 230 extends from opening 220. In one embodiment the lubrication groove 230 includes a lubrication exit groove 230*a* which extends to the central bore 160. In an alternative embodiment the lubrication groove may include a lubrication exit 230*b* (shown in phantom lines) which extends to outer surface 152.

FIG. 6 shows a view of the second plate 170 with its concave curved surface 210 facing upward. The phantom lines shown in FIG. 6 demonstrate that in an embodiment of a leveling assembly the leveling plate with the concave surface may include a lubrication passageway and lubrication groove as well. It is understood that typically only one of the first and second plates 150 and 170 in a leveling assembly will include such features. In the alternative embodiment of FIG. 6 a lubrication fitting 195, such as a zerk fitting is installed into a first opening 265 on the outer surface 172. A lubrication passageway 255 (shown in FIG. 8) extends from first opening 265 to a second opening 225 on concave curved surface 210. A lubrication groove 235 which includes a lubrication exit groove 235*a* is defined in concave surface 210 and connected to lubrication passageway 255 via second opening 225. Exit groove 235*a* extends to central bore 180. An alternate exit groove 235*b* is shown extending to outer surface 172 on second plate 170. Lubrication groove 235 may include one or both of exit grooves 235*a* and 235*b*. Either or both of plates 150 and 170 may have lubrication grooves and passageways as described herein.

FIGS. 7 and 8 depict cross sections of leveling plates 150 and 170. FIG. 7 shows a cross-section view of the first plate 150. Lubrication fitting 190, which may be a zerk fitting, can be seen installed into the lubrication passageway 250. The lubrication passageway extends from the first opening 260 to the second opening 220. FIG. 8 shows a cross-section view of the second plate 170. The phantom lines in FIG. 8 depict the embodiment where plate 170 includes lubrication passageway 255 and lubrication groove 235.

As depicted in FIGS. 1 and 2, the leveling assembly 90, comprising leveling plates 150 and 170 is supported by carrier bar 140. A spacer 130 is positioned between leveling plates 150 and 170 and carrier bar 140. Although in the disclosed embodiment a spacer is used, it is understood that the leveling assembly 90 may be positioned directly on carrier bar 140.

The curvature of the plates 200, 210 should have substantially similar, but complementary radii. The convex surface 200 and the concave surface 210 should fit together (mate) with only minor gaps therebetween (aside from the lubrication grooves and holes). The similarity of radius (or fit) allows for the plates to better spread the force across the full mating (curved) surfaces of the two plates.

The lubrication groove should be created in such a way as to not prevent the plates from sliding relative to each other. The plates need to retain the ability to adjust for misalignments. Referring to the embodiment in which the lubrication groove is in first plate 150, lubrication groove 230 can be a variation in the surface that creates a space between the convex surface 200 and concave curved surface 210 sufficient to allow a lubricant to flow therethrough.

Exit groove 230*a* provides a lubricant between plates 150 and 170, and because the exit is to the central bore 160 may also provide lubrication to the polish rod 100 where it passes through central bores 160 of plate 150. This can reduce friction, and possibly wear.

Therefore, the present method and system are well adapted to attain the ends and advantages mentioned, as well as those that are inherent therein. The particular examples disclosed above are illustrative only, because the present method and system may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered or modified, and all such variations are considered within the scope and spirit of the present method and system. Also, the terms in the claims have their plain, ordinary meaning unless otherwise explicitly and clearly defined by the patentee.

What is claimed is:

1. A leveling assembly comprising:

a first plate having a convex curved surface, the first plate defining a central bore therethrough with a first diameter;

a second plate having a concave curved surface engaged with the convex curved surface and defining a central bore therethrough with a second diameter;

a polish rod passing through the central bore of the first plate and the central bore of the second plate; and one of the first or second plates defining a lubrication passageway extending from a first opening on an outer peripheral surface thereof to a second opening on the curved surface of the plate on which the lubrication passageway is defined, the curved surface of the plate on which the first and second openings are defined having a lubrication groove defined thereon connected to and extending from the second opening, the lubrication groove having a lubrication exit groove extending from the lubrication groove to the central bore of the plate having the lubrication passageway.

2. The leveling assembly of claim 1, the lubrication groove extending to the outer peripheral surface of the plate having the lubrication passageway.

3. The leveling assembly of claim 1, the first plate and the second plate having substantially the same thickness at a periphery thereof.

4. The leveling assembly of claim 1, the lubrication passageway and lubrication groove being defined on the first plate.

5. The leveling assembly of claim 1, a lubrication fitting being installed into the first opening.

6. A leveling assembly comprising:

a first plate having a convex curved surface, the first plate defining a central bore therethrough with a first diameter;

a second plate having a concave curved surface engaged with the convex curved surface of the first plate, the second plate defining a central bore therethrough with a second diameter, one of the first or second plates defining a lubrication passageway extending from a first opening on an outer peripheral surface thereof to a second opening on the curved surface thereof, the curved surface of the plate on which the lubrication passageway is defined having a lubrication groove defined thereon connected to and extending from the second opening, the lubrication groove having a lubrication exit groove extending from the lubrication groove to the central bore of the plate having the lubrication passageway;

a carrier bar positioned below and supporting the first and second plates, the carrier bar defining a central bore therethrough; and a polish rod passing through the central bore of the carrier bar and the central bores of the first plate and the second plate.

7. The leveling assembly of claim 6, the lubrication groove extending to the outer peripheral surface of the plate having the lubrication passageway.

8. The leveling assembly of claim 6, the first plate and the second plate having substantially the same thickness at an outer periphery thereof.

9. The leveling assembly of claim 6, the lubrication passageway and lubrication groove being defined on the first plate.

10. The leveling assembly of claim 6, a lubrication fitting being installed into the first opening.

11. The leveling assembly of claim 10, further comprising a spacer positioned between the first and second plates and the carrier bar.

12. The leveling assembly of claim 6, further comprising a load cell defining a central bore therethrough and supported by the first and second plates, the polish rod passing through the central bore of the load cell.

13. A leveling assembly for use with a pump jack comprising:

a first plate having a convex curved surface, the first plate defining a central bore therethrough with a first diameter;

a second plate having a concave curved surface engaged with the convex curved surface, the second plate defining a central bore therethrough with a second diameter;

a polish rod passing through the central bores of the first plate and the second plate;

one of the first or second plates defining a lubrication passageway extending from a first opening on an outer peripheral surface thereof to a second opening on the curved surface of the plate in which the lubrication passageway is defined, the curved surface of the plate in which the lubrication passageway is defined having a lubrication groove defined thereon connected to and extending from the second opening, the lubrication groove having a lubrication exit groove extending from the lubrication groove to the central bore of the plate having the lubrication passageway; and a load cell supported by the first and second plates.

14. The leveling assembly of claim 13, further comprising the polish rod extending from the pump jack and passing through the central bores of the first and second plates and through a central bore of the load cell.

15. The leveling assembly of claim 14, further comprising a carrier bar positioned below and supporting the first and second plates.

16. The leveling assembly of claim 15, further comprising a spacer positioned between the carrier bar and the first and second plates.

17. The leveling assembly of claim 13, the lubrication passageway being defined in the first plate and the lubrication groove being defined on the curved surface of the first plate.

* * * * *